United States Patent [19]

Aleck

[11] 4,007,616

[45] Feb. 15, 1977

[54] CYLINDRICAL CONTAINERS BY HOUR GLASS FORMATION OF METAL TUBES

[75] Inventor: Benjamin J. Aleck, Jackson Heights, N.Y.

[73] Assignee: Grumman Aerospace Corporation, Bethpage, N.Y.

[22] Filed: Nov. 6, 1975

[21] Appl. No.: 629,648

[52] U.S. Cl. ..... 72/38; 72/302; 72/342; 72/378

[51] Int. Cl.[2] ..... B21D 31/00

[58] Field of Search ..... 113/120 N, 120 S, 120 Z; 72/294, 295, 302, 305, 342, 364, 378, 370, 38; 29/DIG. 21, DIG. 24, DIG. 41, DIG. 42; 219/8.5, 59

[56] References Cited

UNITED STATES PATENTS

| | | | |
|---|---|---|---|
| 545,022 | 8/1895 | Jackson | 72/302 |
| 2,051,949 | 8/1936 | Inscho | 72/302 |
| 3,735,463 | 5/1973 | Merola | 29/DIG. 41 |
| 3,740,991 | 6/1973 | Walraven et al. | 72/342 |

FOREIGN PATENTS OR APPLICATIONS

| | | | |
|---|---|---|---|
| 1,285,872 | 8/1972 | United Kingdom | 72/364 |

*Primary Examiner*—Lowell A. Larson
*Attorney, Agent, or Firm*—Richard G. Geib; Mellor A. Gill

[57] ABSTRACT

A process of manufacture to produce low cost pressure vessels from a length of metal tubing by use of localized heat and/or axial tensile force to shrink the diameter of the tubing at selected locations of a predetermined starting length approximately one diameter long and many diameters apart to permit subsequent separation to form open-ended pressure vessels. Subsequent conventional swaging operations could thicken and reduce the end diameters so they can be threaded.

21 Claims, 8 Drawing Figures

CYLINDRICAL CONTAINERS BY HOUR GLASS FORMATION OF METAL TUBES

BACKGROUND

Prior attempts that are presently known to have been disclosed in the field of this invention may be seen in U.S. Pat. No. 2,222,762. It was there intended that hollow bodies adapted for use as pressure vessels be produced from tubular metallic bodies by expanding the walls of the bodies to form a series of enlarged zones, such as spheroids, spaced by parts of the initial tube.

While this is a method of mass production, expensive control measures are required in order that the vessel walls have the appropriate thickness distribution. Otherwise considerably lower pressure resistivity than that available from optimal use of the material will result.

Other attempts at low cost production of cylindrical (metal) pressure vessels that have been noticed in the prior art include the U.S. Pat. No. 2,386,246. In this teaching it is desired to take two cylindrical shells each with one end closed and weld them together at their open ends. Thereafter heat is applied to the welded ends which are spun to a neck portion. This action thickens the closure and neck regions.

This patent teaches to apply a compressive axial force to thicken the neck. The purpose of the present invention is to cause a thinning as the radius is decreased.

In contrast to these known prior art attempts at obtaining metal containers this invention permits one to simplify the manufacture by taking a tubing of long length and doing identical, but optionally simultaneous, operations at a large number of stations. The stations, or areas, as general rule, extend for a length that is approximately equivalent to the diameter of the metal tube; and they are spaced apart a distance equivalent to several diameters. It is also intended to apply local tension to these areas. To avoid subsequent internal cleaning costs to remove oxides which form at elevated temperature if the metal is exposed to air, one may fill the tube with an inert gas such as argon or draw a vacuum to remove the air. The use of a long tube makes possible the forming of 2 necks at each station simultaneously.

This invention for the first time makes it possible to control the resulting thickness and associated radius distribution whereby a quality pressure vessel can be obtained. This control is based on the plasticity relations which apply for the given material as a function of temperature.

One may well attempt, upon an understanding of the present invention from the following description, to view this as an extension of glass forming techniques to the art of metal working. The differences are described below. The forming of glass is done when it is nearly molten, and it cannot support its own weight. A glass tube is sealed by relying on surface tension to draw the open end together. Glass vessels, made by somewhat similar means, do not and are not required to conform to the thickness requirements in a high quality pressure vessel. Finally, the use of constant strain-rate, stress-strain data is not taught in the fabrication of glass pressure vessels regardless of whether they are of appropriate high performance thickness distribution.

In conclusion then this invention has found two applications where it has filled a long standing need. One is in bringing to the art an economic manufacture of high performance pressure vessels; and the second is in bringing to the art the economic manufacture of low weight collapse resistant pressure vessels. Recently still a third possibility for this invention is in the improvement of the manufacture of a manifolded string of pressure vessels whereby one can have a far greater number of vessels with integral manifolds in a space than heretofore possible due to number of attachments, etc.

DRAWING DESCRIPTION

DETAILED DESCRIPTION

Figure 1:
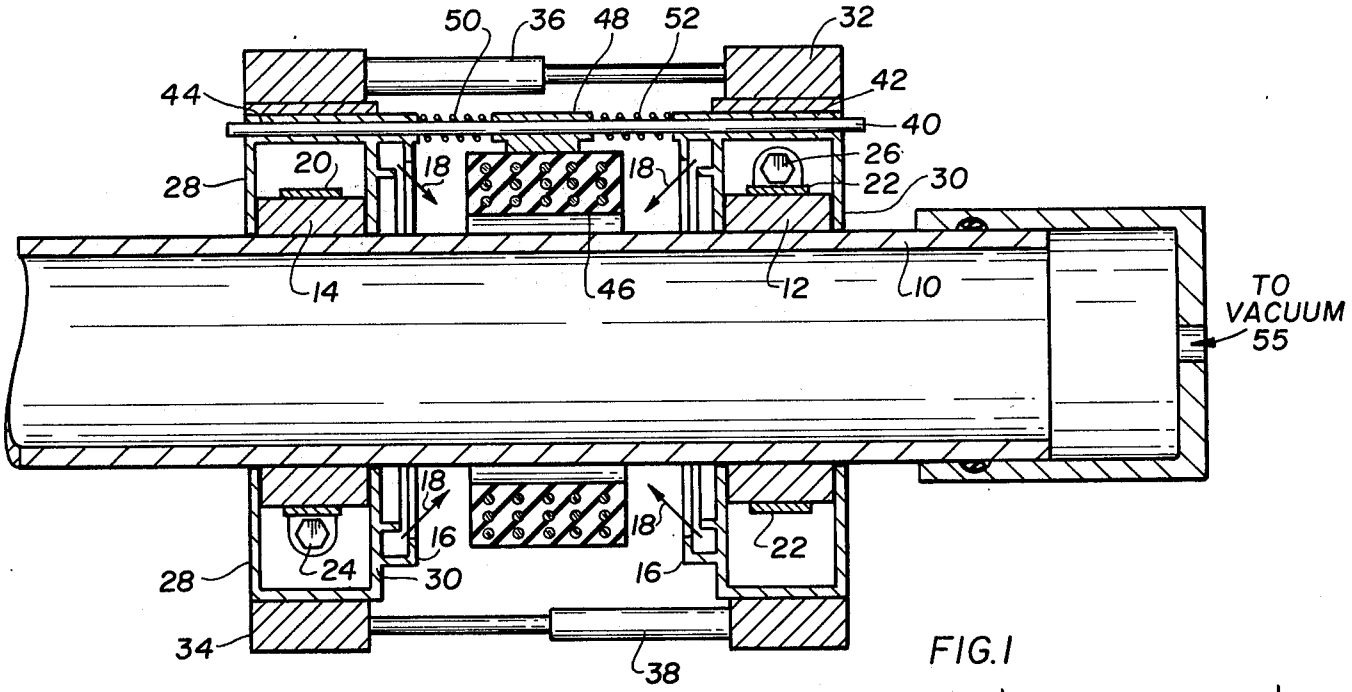
FIG. 1 is a partial cross sectional view of a metal tube showing a work station thereabout.

With particular regard to FIG. 1 there is shown a tube 10 on which are placed split friction rings 12, 14. Clamps 20 and 22 are placed over the rings and secured, as by bolts 24 and 26, respectively, to lock rings 12 and 14 to tube 10.

As seen in FIG. 1 an actuator assembly is fitted by rails 28 and 30 to each clamped ring. The actuator assembly includes semicircular brackets 32 and 34 connected by hydraulic actuators 36 and 38 and by a rod 40 that is slidably mounted by holes 42 and 44 in rings 32 and 34.

An electrical coil heater 46 is mounted by a sleeve 48 to be centered between rings 32 and 34 by springs 50 and 52. This type of heater mounting will insure centralization of the heat as the rings 12 and 14 are moved away from each other as by actuators 36 and 38.

With such apparatus tube 10 is heated locally over a length approximately one diameter long at one or a series of stations, such as the one shown by FIG. 1, many diameters apart.

The heated zones are caused to shrink in diameter and thickness as a result of inelastic elongation of the heated zone. The port 55 leads to a vacuum chamber or to an inert gas such as argon. It is to be understood that the other end of the tube 10 may be closed or could be connected to the same vacuum or inert gas source. Actuators 36 and 38 create longitudinal strain in tube 10 creating the structure shown by FIG. 3 as explained below. If the heated zone were very long, substantially the entire length would be of constant reduced radius and thickness between the held ends. However since the portions to either side of the heating means are cold and strong they cannot contract and the shape of FIG. 2, (hour-glass) will be produced.

Figure 2A:
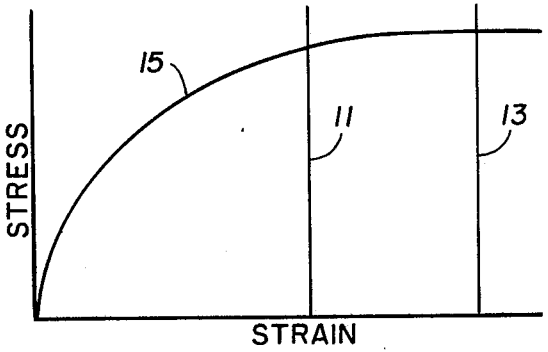
FIG. 2A is a graphical stress-strain illustration.
Figure 2:
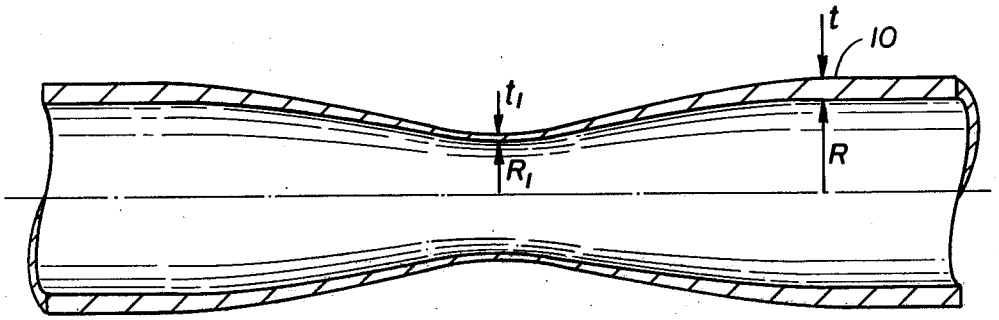
FIG. 2 is a partial cross section of an intermediate length of tube.

As seen in FIG. 2 the radius (R) of the tube is to the thickness (t) in the unworked state as the radius ($R_1$) is to the thickness ($t_1$) in the hour-glassed portion. In order to keep these factors in proportion it is necessary, at a selected temperature, never to exceed the material's ultimate strength associated with a given strain rate. More specifically with reference to the graphical illustration of FIG. 2A the strain used, 11, is less than the maximum strain, 13, for the material. It is important to control the process in accordance with the strain developed in that this varies more controllably than stress, as the curve 15 shows.

If necessary to increase the available strain capability of the particular material the strained zone is reheated to anneal it. The cycle can be repeated as often as required to develop the desired reduction in diameter and thickness in the hour glass region.

Figure 3:
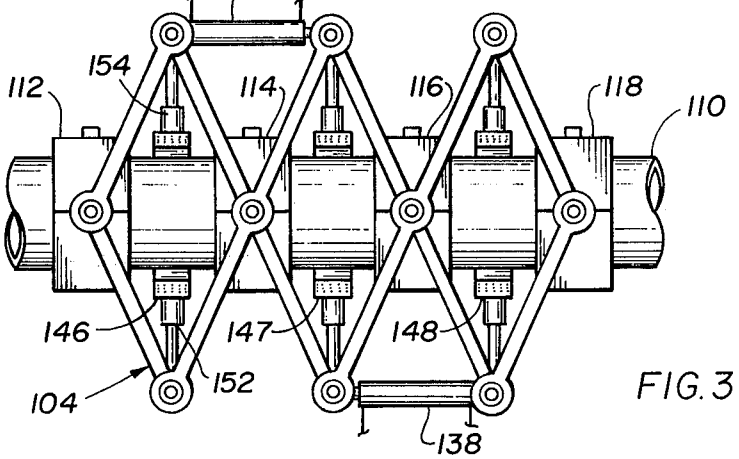
FIG. 3 is a side view of a multistation apparatus in accordance with this invention.

With regard now to FIG. 3 there is shown in greater detail how this invention contemplates gang forming operations. There is a plurality of friction blocks 112, 114, 116 and 118 affixed to each other to frictionally clamp on a tube 110 at locations that allow a tube length therebetween of at least one diameter.

Figure 4:
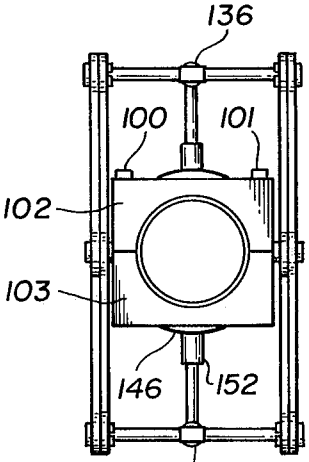
FIG. 4 is an end view of the apparatus of FIG. 3.

As seen in FIG. 4 bolts 100 and 101 install the blocks, which are semicircular halves 102 and 103, to each other and to tube 110.

A scissors link means 104 joins blocks 112, 114, 116 and 118 together and a pair of actuators 136 and 138 are connected in this linkage to operate same. A plurality of heaters 146, 147 and 148 are operatively located between the blocks as aforesaid. These could be electric radiant or induction heating coils, as in FIG. 1, or oxyacetylene manifolds, and temperature monitoring could be by thermocouple or by fiber optic means, not shown.

The tube 110 would be end supported, as in FIG. 1 and on steady rests (not shown) along the length.

Figure 5:
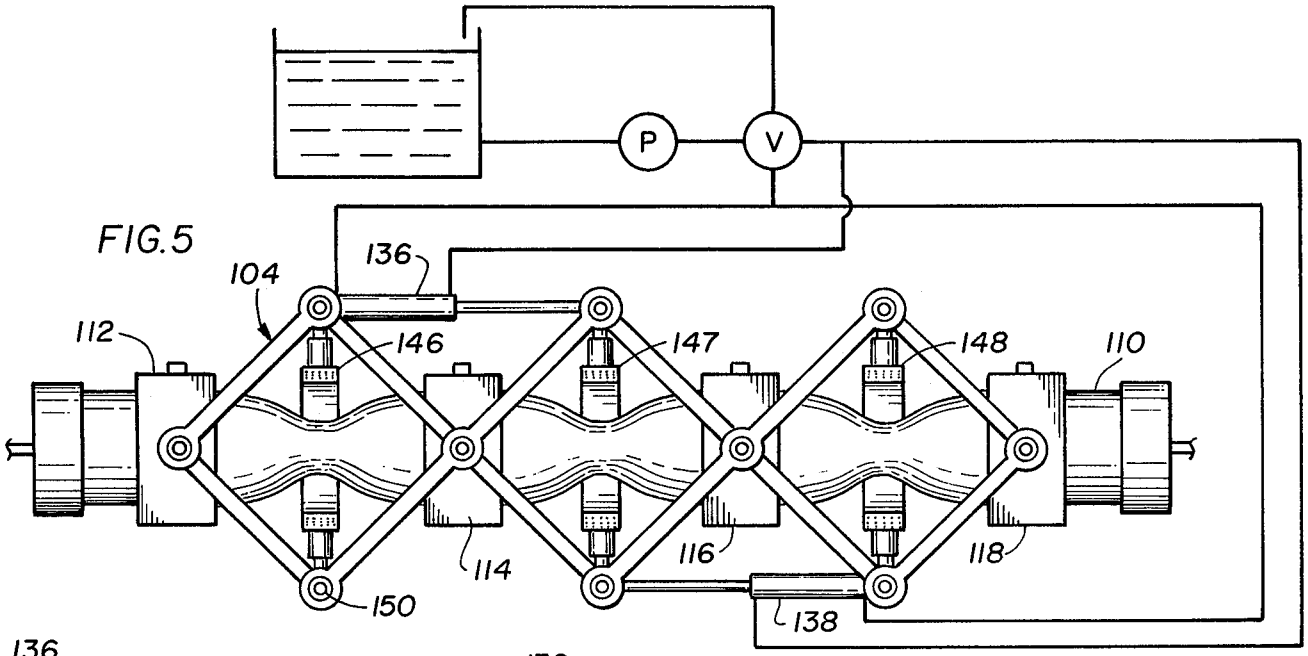
FIG. 5 is a side view of the apparatus of FIG. 3 working to neck down areas of a tube.

A hydraulic system is connected to actuators 136 and 138 to cause the scissors link means to apply the same longitudinal strain on the tube walls between the blocks 112 and 114; 114 and 116; 116 and 118. At the same time heaters 146, 147 and 148 apply localized heat that is the greatest intermediate the blocks. The heaters are mounted as by telescoping rods 152 and 154 from pins 150 FIG. 5 and hence will stay in the proper location. Prior to this operation a vacuum has been pulled within tube 110 and a metered supply of argon has been allowed to flow, as necessary, through tube 110. As noted, this prevents oxide formations inside tube 110 whereby cleaning, after forming, of the interior is not necessary.

If desired, a cooling manifold 16 (see FIG. 1) is located to direct a cooling fluid such as a mist of argon droplets in argon or nitrogen droplets in nitrogen along the direction of arrows 18 to each side of the heater 46 to limit the heated area to that desired under the heater.

The next operation would be to cut the tube into finite lengths in the region of reduced diameter. This produces a vessel having two necked down ends. It is necessary to cold work the ends to return some cross sectional thickness thereto so that threads may be machined on, or rolled therein, for closure caps (not shown) without adversely affecting the strength.

Figure 6:
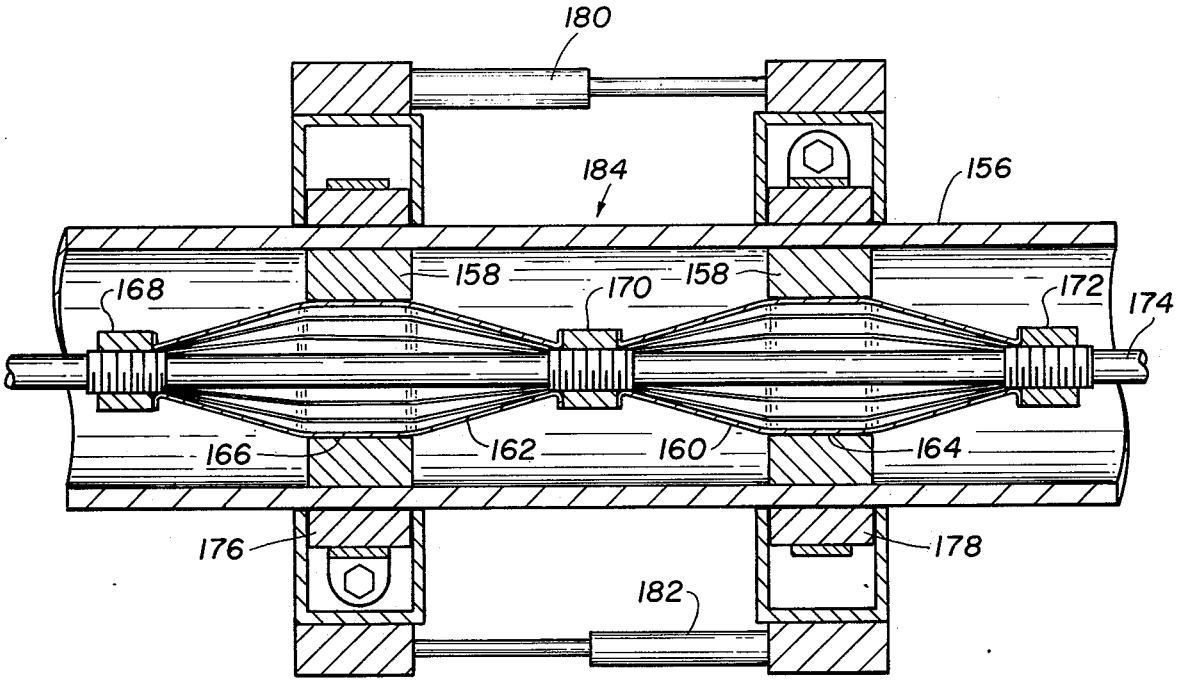
FIG. 6 is a partial cross sectional view of a metal tube showing an alternative work station thereabout.

Another application of this invention is for manufacturing low weight collapse resistant pressure vessels by a process using the apparatus shown by FIG. 6. There the tube 156 is provided with a plurality of rings 158 that are located at predetermined intervals by cylindrical springs, such as springs 160 and 162 having surfaces 164 and 166. Collars 168, 170 and 172 are fastened to a rod 174 at selected intervals to provide abutments for the springs. Actually surfaces 160, 162 releasably hold rings 158 among collars 168, 170 abd 172 so as to permit upon completion of the forming of tube 156 the removal of rod 174 and springs 160 and 162 as well as removal of collars 168, 170 and 172.

In operation rings 176 and 178 are clamped to tube 156 about the area of rings 158 therein. Actuators 180 and 182 then apply tensile force to the region 184 of the tube. This could be by pulling on the ends of tube 156 rather than over some intermediate length. In the foregoing embodiment the rings 158 with rings 176 and 178 limit the loaded length to region 184 of the tube 156. Region 184 will begin to thin its wall thickness and its external diameter without rupture so long as the load is applied at a strain rate so that the ultimate strength for the material of tube 156 will not be exceeded. A repeated stretch and anneal operation may be required to obtain the desired hour-glass shape.

The rings 158 could be placed to be a distance from one another equal to the tube diameter or at a lesser or greater distance. The spacing permits manufacture of one or a series of toroidal segments that carry external pressure between rings in a suspension bridge fashion: i.e. the region 184 will be decreased in diameter as tube 156 stretches in the same manner as that shown for the heat and load process by FIG. 2. The region 184 will have its walls between the rings 158 loaded in tension whereby it will be possible to use the structure to withstand longitudinal stress close to the yield point of the material. Also the rings 158 will carry the transverse component of the wall load. Actually the key to formation of the walls, as aforesaid, is that the walls of tube 156 be permitted to buckle hoopwise with the pressure load being carried along the meridian direction.

The degree of hour-glassing required for this application is much less than for the high performance pressure vessels.

Figure 7:
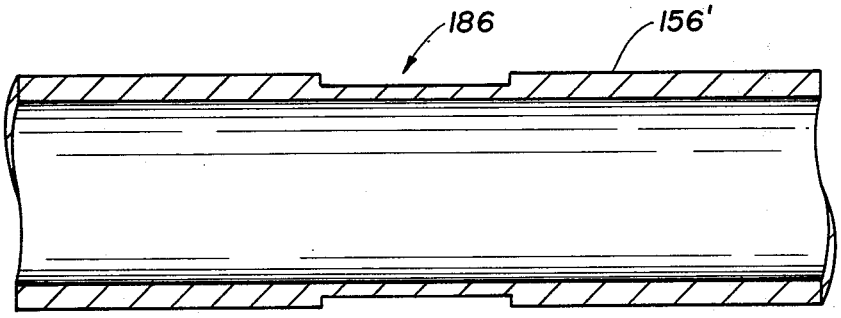
FIG. 7 is a partial cross-section of an intermediate length of tube prepared for processing per this invention.

As seen in FIG. 7 the rings could be eliminated in cold working a tube 156' by reducing the cross sectional wall thickness thereof in an area 186 between the devices to apply tensile force, as aforesaid. In this regard it has been found that one must take into the yield and ultimate strength of the material and operate within the range between these known limits. Also the forming is more readily accomplished with a material which exhibits a large difference between yield and ultimate strengths.

As various changes may be made in the form, construction and arrangement of the parts in achieving my innovative method of manufacture without departing from the spirit and scope of my invention and without sacrificing any of its advantages, it is to be understood that all matter herein is to be interpreted as illustrative and not in any limiting sense.

Having described a method of manufacture for a pressure vessel having especial utility it is now desired to set forth the following claims for the invention.

I claim:

1. The method of making cylindrical containers comprising:

mounting a metal tubular stock within holders so as to localize a cylindrical area for axial tensile forces and heating;

heating the tubular stock cylindrical area while creating an inert atmosphere by applying a vacuum and/or inert gas within the tubular stock, especially at the original cylindrical heated area to prevent the need for a subsequent oxidation removal process;

pulling, while heating and creating the inert atmosphere, the tubular stock to impart local tension in the heated cylindrical area to reduce the stock diameter and thickness thereat.

2. The method of claim 1 and further comprising the step of cooling the stock to either side of the selected areas heated.

3. The method of making cylindrical containers according to claim 1 and further characterized by the step of limiting forces reducing diameter to a rate and magnitude of strain such that ultimate strength is not exceeded in heated areas.

4. The method of claim 3 and further comprising the step of repeatedly annealing the heated area and restraining till the desired degree of shaping, i.e. hour glass, is achieved.

5. The method of making metallic containers comprising the steps of:

inserting rings in a tubular body;

locating the rings at preselected intervals in the unstrained body such that the rings may have limited float in an axial direction of the body;

affixing means to the body adjacent the rings to grip the body at spaced locations of the rings while permitting the rings to float within the body;

placing actuator means between the means affixed to the body at the ends at least to apply tensile forces to said body between the rings;

actuating the actuator means to create the tensile forces in the body in the interval between the means affixed to the body adjacent the rings; and limiting the rate and magnitude of the tensile forces created to be less than ultimate strength at any point for the material of the body undergoing tensile forces.

6. The method of claim 5 and further comprising the step of heating the body within the area being tensioned.

7. The method of claim 6 and further comprising the step of cooling the body to either side of the area heated.

8. The method of claim 7 and further comprising the step of repeatedly annealing the heated area and restraining till the desired degree of shaping, i.e. hour glass, is achieved.

9. The method of making cylindrical container bodies from metal tubular means each having axially aligned open ends which method comprises:

attaching clamps at selected intervals to the tubular means;

interposing heating means to be operative at the selected intervals to raise the temperature of the tubular means locally thereat;

attaching means to the clamps to create tensile loads on the tubular means locally between the clamps while operating the heating means, said tensile loads being such as will provide a desired stress-strain curve; and severing the tubular means in the areas heated and pulled to a reduced diameter in regard to the tubular means whereby individual necked container bodies may be obtained from one tubular means.

10. The method of claim 9 wherein the step of attaching clamps includes locating same to be separated so as to work an area of said tubular means equivalent in length to its diameter.

11. The method of claim 10 and further including the step of maintaining the heating means location centrally of the clamps.

12. The method of claim 11 and further comprising the step of mechanically working an area of the severed ends to restore thickness thereto.

13. The method of claim 9 and further comprising cooling the tubular means as it emerges from both sides of the heating means.

14. The method of making cylindrical containers according to claim 9 and further characterized by the step of limiting forces reducing diameter to a rate and magnitude of strain such that ultimate strength is not exceeded in heated areas.

15. The method of claim 14 and further comprising the step of repeatedly annealing the heated area and restraining till the desired degree of shaping, i.e. hour glass, is achieved.

16. A method of making necked down tubular means comprising the steps of:

creating a plurality of heated zones in tubular stock;

simultaneously with the creating of heated zones creating tensile loads within the heated zones; and limiting the deforming of the heated zone by the tensile loads in maintaining the ratio of radius of the tubular means to the thickness thereof in the area outside the heated zones equal to the ratio of the radius to the thickness thereof in the heated zones in obtaining thinning of cross sectional thickness and reduction in diameter of the tubular means while elongating the region by a factor twice as large.

17. The method of claim 16 and further comprising the step of preventing oxidation within the tubular means.

18. The method of claim 17 wherein the step of preventing oxidation is by drawing a vacuum in the tubular means.

19. The method of claim 16 and further comprising the step of cooling said tubular stock as it emerges from said heated zone during elongation.

20. The method of making cylindrical containers according to claim 16 and further characterized by the step of limiting forces reducing diameter to a rate and magnitude of strain such that ultimate strength is not exceeded in heated areas.

21. The method of claim 20 and further comprising the step of repeatedly annealing the heated area and restraining till the desired degree of shaping, i.e. hour glass, is achieved.

* * * * *